United States Patent [19]

Meiners et al.

[11] Patent Number: 4,929,920

[45] Date of Patent: May 29, 1990

[54] COMPACT CIRCUIT BREAKER WITH AN ELECTRONIC TRIP UNIT

[75] Inventors: David J. Meiners, Southington; Robert A. Morris, Burlington; David Arnold, Chester; Roger N. Castonguay, Terryville; Joseph M. Palmieri, Southington, all of Conn.

[73] Assignee: General Electric Company, New York, N.Y.

[21] Appl. No.: 370,948

[22] Filed: Jun. 23, 1989

[51] Int. Cl.[5] ..... H01H 9/02

[52] U.S. Cl. ..... 335/202; 335/42

[58] Field of Search ..... 335/6, 8–10, 335/35, 42, 202; 200/293, 305, 304

[56] References Cited

U.S. PATENT DOCUMENTS

| | | | |
|---|---|---|---|
| 4,266,209 | 5/1987 | DiMarco et al. | 335/17 |
| 4,589,052 | 5/1986 | Dougherty | 361/94 |
| 4,652,975 | 3/1987 | Scott | 361/404 |
| 4,679,019 | 7/1987 | Todaro et al. | 335/172 |
| 4,728,914 | 3/1988 | Morris et al. | 335/6 |
| 4,733,211 | 3/1988 | Castonguay et al. | 335/192 |
| 4,736,174 | 4/1988 | Castonguay et al. | 335/167 |
| 4,754,247 | 6/1988 | Raymont et al. | 335/202 |
| 4,794,356 | 12/1988 | Yu et al. | 335/13 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact current limiting circuit breaker with an electronic trip unit arranged within the circuit breaker cover and current transformers in the circuit breaker case incorporates reinforcement ribs in the cover to provide added strength. The cover also includes line terminal plugs that removably attach to the cover for preventing inadvertent access to the circuit breaker line terminals when the circuit breaker is energized. Protrusions formed on the bottom surface of the circuit breaker cover under the trip unit provide further strength while cooperating with flexible pads on the top of the current transformers to automatically compensate for manufacturing tolerances.

8 Claims, 4 Drawing Sheets

COMPACT CIRCUIT BREAKER WITH AN ELECTRONIC TRIP UNIT

BACKGROUND OF THE INVENTION

U.S. Pat. No. 4,754,247 describes a molded case circuit breaker that includes an accessory cover fastenedto the circuit breaker top surface which provides access to an auxiliary switch, an electromagnetic trip actuator and an electronic trip unit contained within the circuit breaker cover. This Patent is incorporated herein for reference purposes and should be reviewed for its description of the arrangement of the accessory cover and its teachings of a plurality of line terminal plugs on the circuit breaker cover opposite the accessory cover to prevent inadvertent contact with the energized line terminal connections.

U.S. patent application Ser. No. 370,947 entitled "Molded Case Circuit Breaker Line Terminal Plug" describes a line terminal plug that multi-functionally prevents inadvertent contact with the energized line terminal connections as well as directing the arc gases formed within the circuit breaker case out from the circuit breaker cover. The line terminal plugs are installed at the factory and are removed at the installation site in order to provide access for connecting the line terminal lugs within an associated electrical power distribution circuit. After the line terminal connections are made, the line terminal plugs must be reinstalled.

One purpose of the instant invention is to provide a circuit breaker cover wherein the line terminal plugs cooperate with the tool used to connect the line terminals to the electrical distribution conductors to facilitate removal and prevent inadvertent misplacement of the line terminal plugs. Other objects of the invention include means for strengthening the circuit breaker cover to improve its resistance to stress under intense overcurrent conditions. A further object of the invention is to provide a means for compensating for manufacturing tolerances when the circuit breaker cover is attached to the circuit breaker case.

SUMMARY OF THE INVENTION

A molded case circuit breaker cover includes line terminal plugs that are sized to accept the hex wrench used to install the line terminal screws in a press-fit relation whereby the line terminal plugs remain removably attached to the wrench. The cover also includes reinforcement ribs integrally-formed along a bottom portion along with integrally-formed protrusions. The protrusions contact flexible pads on the top surface of the current transformers to automatically compensate for manufacturing tolerances between the case, cover and transformers and to prevent disruption of the electrical connections between the transformer pin connectors and the trip unit printed circuit board.

DESCRIPTION OF THE PREFERRED EMBODIMENT

Figure 1:
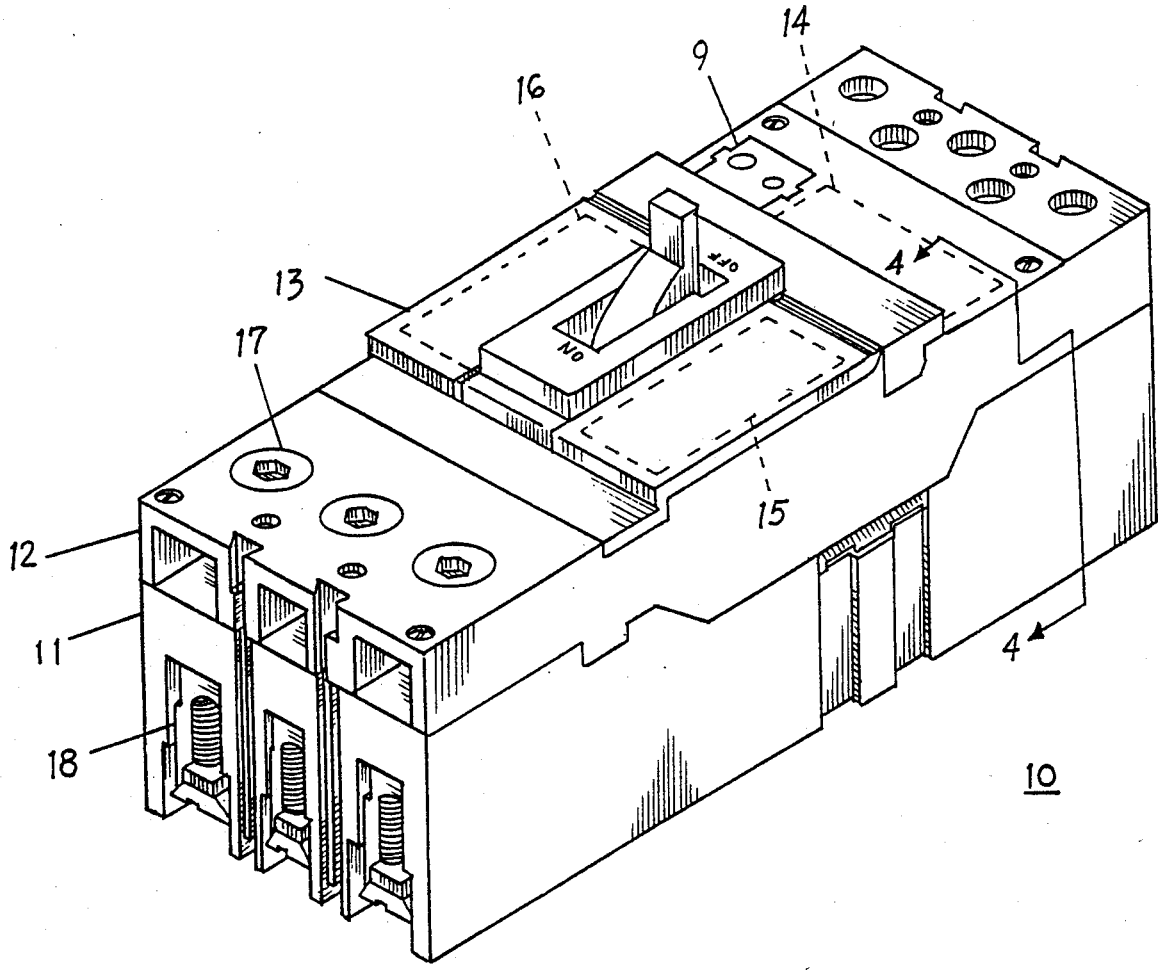
FIG. 1 is a top perspective view of the compact circuit brea according to the invention.

A compact circuit breaker 10 such as described in aforementioned U.S. Pat. No. 4,754,247 is shown in FIG. 1 to consist of a circuit breaker case 11, circuit breaker cover 12 and accessory cover 13. An electronic trip unit 14 such as described in U.S. Pat, No. 4,589,052, which Patent is incorporated herein for reference purposes, is contained within a recess formed in the cover and is accessible through the accessory cover. Also accessible is the trip actuator 15 which is described in U.S. Pat. No. 4,679,019 and an auxiliary switch 16 such as that described in U.S. Pat. No. 4,794,356. A rating plug 9 such as described in U.S. Pat. No. 4,728,914 connects with the trip unit 14 and is directly accessible exterior to the circuit breaker cover. Three line terminal lugs 18 located under the three corresponding line plugs 17 define the line end of the compact circuit breaker.

Figure 2:
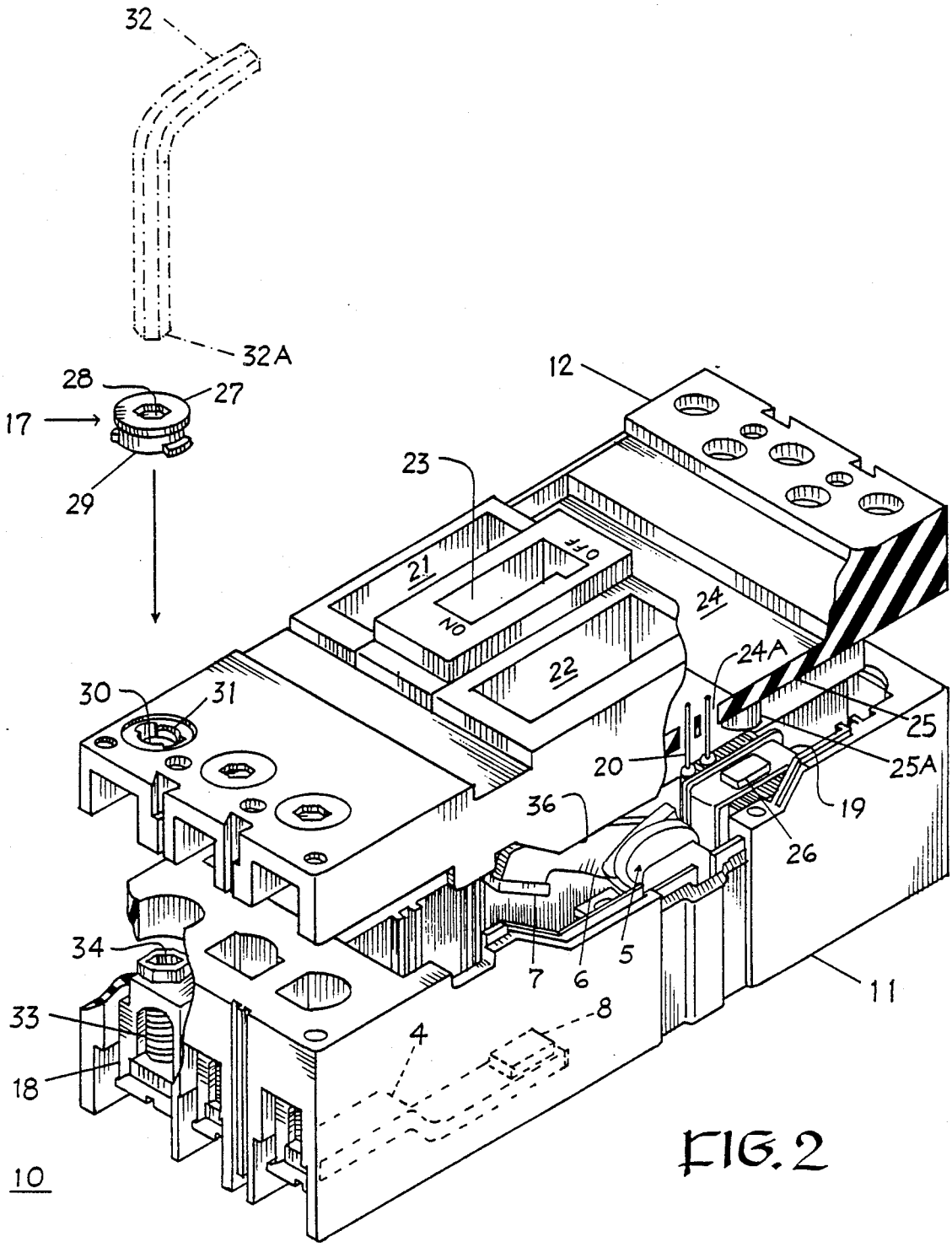
FIG. 2 is a top perspective view of the compact circuit breaker of FIG. 1 with the accessory cover removed and with a part of the circuit breaker cover and case removed.

One line plug 17 is depicted in FIG. 2 prior to insertion within the cover 12 of the compact circuit breaker 10. The line plug consists of a molded plastic cylindrical top 27 which includes a hex wrench-receiving recess 28 and an elongated shoulder 29. A typical hex wrench 32 is depicted in phantom to show the hex-shaped end 32A that is received within the hex recess 28 for removing the line plug from and inserting the line plug within the circuit breaker cover. The hex recess is formed to a press-fit configuration with the hex wrench end 32A such that when the end is inserted within the recess for removing the line plugs from the cover, the line plug remains attached to the hex wrench because of the press-fit relation and must be removed manually. The line plug is inserted within the line terminal plug recess 30 formed within the circuit breaker cover and which centrally includes a keyway 31 shaped to accept the elongated shoulder 29. The shoulder is aligned with the keyway when the line plug is inserted therein. The line plug is then rotated such that the shoulder 29 fits under the line terminal plug recess 30 and cannot be removed until further rotated such that the shoulder again lines up within the shaped keyway 31. The same hex wrench 32 fits within the hex-shaped recess 34 on the line terminal screw 33 which is arranged within the line terminal lug 18 for connecting with the electrical distribution conductor or cable. As described in the aforementioned U.S. Pat. No. 4,754,247 the cover 12 includes an integrally-formed auxiliary switch recess 21 and trip actuator recess 22 on opposite sides of the handle operator slot 23. A trip unit recess 24 is also integrally-formed within the cover to support the trip unit 14 described earlier with reference to FIG. 1. The current transformers 19 are arranged within the case 11 such that the current transformer pin connectors 20 project upward through corresponding apertures 24A formed within the trip unit recess for electrical connection between the trip unit and the current transformers. The interconnection between the current transformers and the electronic trip unit is described within U.S. Patent 4,652,975. In order to relieve the strain exerted on the current transformer pin connectors, and to take up for any manufacturing tolerances between the case, current transformers and the cover, a flexible pad 26 is positioned on the top surface of the current transformers and interacts with corresponding circular protrusions 25A integrally-formed on the bottom 25 of the trip unit recess. When the cover is later fastened to the case, the flexible pad compresses to take up any manufacturing tolerances caused by differences in the cover, case or current transformer specifications while providing a slightly flexible connection between the cover and the case to relieve any tension that would otherwise be exerted upon the current transformer pin connectors 20. The circuit through the compact circuit breaker is maintained by connection between the fixed contact 8 arranged at the end of the line terminal strap 4 and the movable contact 7 arranged at the end of the movable contact arm 6. The movable contact arm is carried by a crossbar assembly generally indicated at 5, which is described in U.S. Pat. No. 4,733,211. The movable contact arm and movable contact are driven to their open conditions by means of the operating mechanism which is described in U.S. Pat. No. 4,736,174 and omitted for purposes of clarity. The trip unit 14 shown in FIG. 1 and also omitted from the trip unit recess, interacts with the operating mechanism by means of the trip actuator which was described earlier with reference to FIG. 1.

Figure 3:
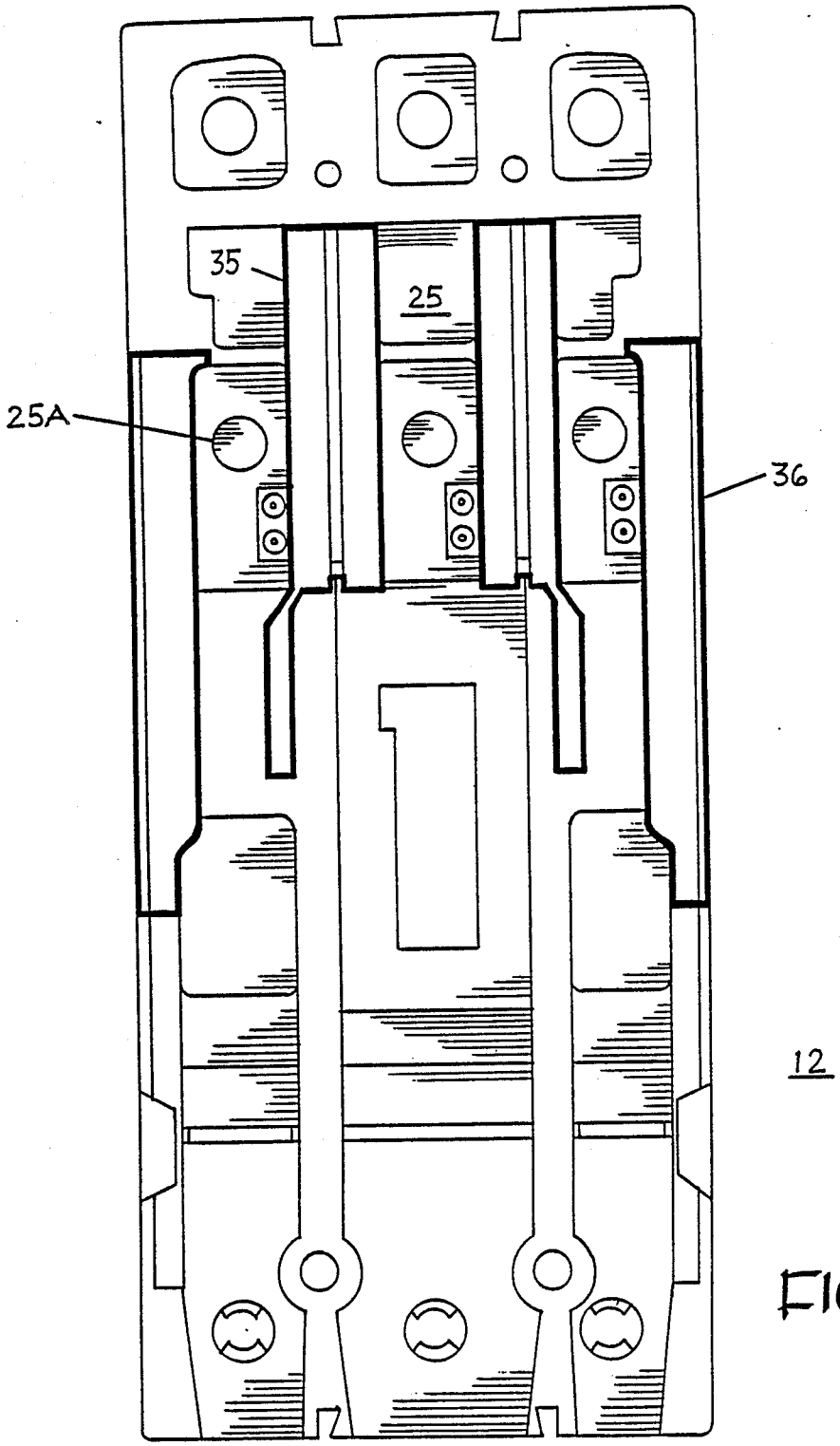
FIG. 3 is a bottom planned view of the circuit breaker cover depicted in FIG. 2.

Further reinforcement to the cover 12 is provided by a pair of outer reinforcement ribs 36 integrally-formed on the bottom surface of the Circuit breaker cover 12 shown in FIG. 3 and overlapping the bottom 25 of the trip unit recess as best seen in FIG. 2. Inner reinforcement ribs 35 that also extend along the bottom of the trip unit recess provide further support to the circuit breaker cover and thereby prevent the circuit breaker cover from damage from the high pressures that are generated during intense overcurrent circuit interruption conditions.

Figure 4:
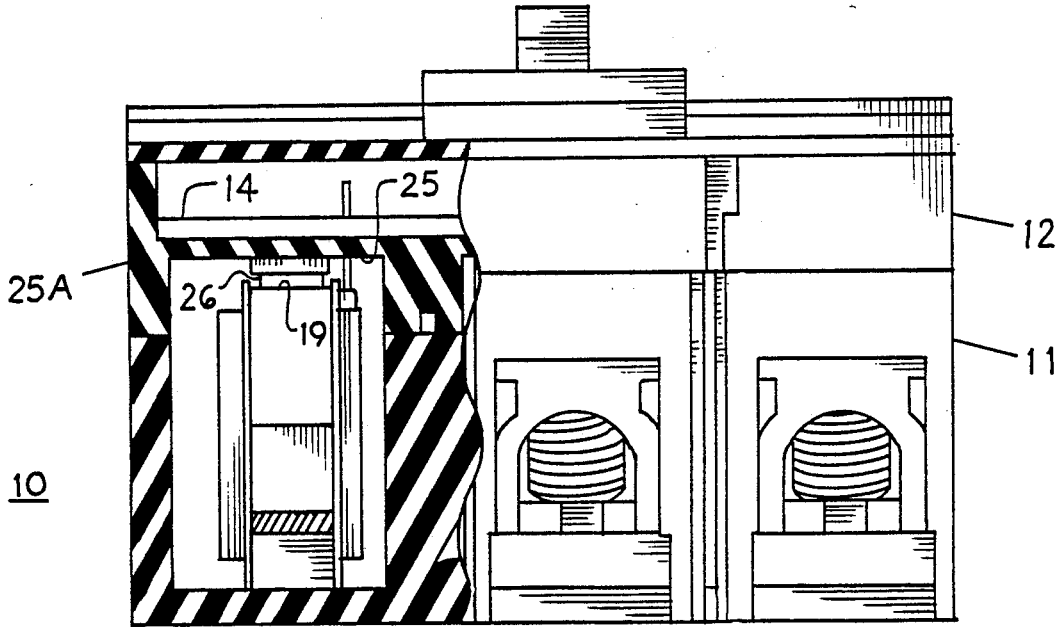
FIG. 4 an end view in partial section of the compact circuit breaker of FIG. 1.

The added structure provided by the outer reinforcement ribs 36 and the circular protrusions 25A is best seen by now referring to the circuit breaker 10 depicted in FIG. 4. The cover 12 is fastened to the case 11 such that the bottom protrusions 25A trap the flexible pads 26 between the bottom 25 of the trap unit recess and the tops of the current transformers 19. The current transformer pin connectors 20 pass through both the bottom 25 of the trip unit recess and the trip unit 14 in the manner described earlier. The compressive properties of the flexible pads 26 relieve any vibrational stress that may occur when the circuit breaker is connected within an electrical distribution circuit, as well as when the circuit breaker is in transit between the point of manufacture and the installation site. The ability of the flexible pads 26 to absorb vibrational energy greatly reduces the stresses that otherwise would be seen by the transformer pin connectors.

A compact electric circuit breaker with an electronic trip unit has herein been described as having novel line terminal plugs inserted within the circuit breaker cover and structural reinforcement members integrally-formed within the bottom thereof. The cooperation between the structural members and corresponding resilient trans former pads have been shown to substantially reduce any vibrational forces transmitted to the transformer pin connectors as well as to take up any manufacturing tolerances between the circuit breaker cover, case and current transformer.

Having thus described our invention, what we claim as new and desire to secure by Letters Patent is:

1. A circuit breaker comprising:

a molded plastic circuit breaker case and cover;

a pair of separable contacts within said case and arranged for separation upon occurrence of an overcurrent condition by means of an operating mechanism and an electronic trip unit;

a plurality of current transformers within said case under said trip unit and connected with said trip unit by pin connectors projecting through said circuit breaker cover and said trip unit; and reinforcing ribs integrally-formed within a bottom of said circuit breaker cover to provide added strength to said circuit breaker cover during said overcurrent condition.

2. A circuit breaker comprising:

a molded plastic circuit breaker case and cover;

a pair of separable contacts within said case and arranged for separation upon occurrence of an overcurrent condition by means of an operating mechanism and an electronic trip unit; and a plurality of current transforms within said case under said trip unit and connected with said trip unit by pin connectors projecting through said circuit breaker cover and said strip unit;

said circuit breaker cover including a plurality of line terminal access holes formed in a keyway configuration to accept a corresponding plurality of line plugs, said line plugs comprising a cover having a shaped recess on a top surface and an elongated shoulder on an opposite surface, said elongated shoulder becoming aligned within said keyway and upon rotation becomes positioned under said cover out of alignment with said keyway to thereby retain said line plugs under said circuit breaker cover, said shaped recess being formed to accept a similarly shaped wrench in a press-fit relation whereby said line plug is retained by said similarly shaped wrench when removed from said circuit breaker cover.

3. The circuit breaker of claim 1 including an accessory cover arranged over said circuit breaker cover to prevent access to said trip unit contained within a trip unit recess integrally-formed within said circuit breaker cover.

4. The circuit breaker of claim 3 wherein said reinforcing ribs extend under said trip unit recess.

5. The circuit breaker of claim 1 including a plurality of protrusions extending from a bottom surface of said trip unit recess thereby providing added reinforcement to said circuit breaker cover.

6. The circuit breaker of claim 5 including a plurality of flexible pads arranged on a top surface of said current transformers under said circular protrusions, said protrusions compressing said flexible pads against said top surface.

7. The circuit breaker of claim 2 including a corresponding plurality of line terminal screws on said case, said line terminal screws having a tool-receiving recess of similar shape to said line plug recess.

8. The circuit breaker of claim 5 wherein said protrusions comprise a circular configuration.

* * * * *

UNITED STATES PATENT AND TRADEMARK OFFICE

CERTIFICATE OF CORRECTION

PATENT NO. : 4,929,920

DATED : 5/29/90

INVENTOR(S) : Meiners et al.

It is certified that error appears in the above-identified patent and that said Letters Patent is hereby corrected as shown below:

IN THE CLAIMS:

Claim 2
Col. 4, line 23, change "transforms" to --transformers--;
line 26, change "strip" to -- trip --.

Signed and Sealed this

Twenty-eighth Day of May, 1991

*Attest:*

*Attesting Officer*

HARRY F. MANBECK, JR.

*Commissioner of Patents and Trademarks*